US005454316A

United States Patent [19]

Ohta et al.

[11] Patent Number: 5,454,316

[45] Date of Patent: Oct. 3, 1995

[54] PRINTING PLATE LOCK-UP APPARATUS FOR PLATE CYLINDER

[75] Inventors: Hideo Ohta, Tokyo; Masahiko Miyoshi, Kanagawa, both of Japan

[73] Assignee: Kabushiki Kaisha Tokyo Kikai Seisakusho, Tokyo, Japan

[21] Appl. No.: 283,163

[22] Filed: Aug. 3, 1994

[30] Foreign Application Priority Data

Nov. 4, 1993 [JP] Japan ..... 5-275198

[51] Int. Cl.[6] ..... B41F 27/06

[52] U.S. Cl. ..... 101/415.1; 101/378; 101/382.1

[58] Field of Search ..... 101/415.1, 378, 101/382.1, 383, 375

[56] References Cited

U.S. PATENT DOCUMENTS

| | | | |
|---|---|---|---|
| 2,157,621 | 5/1939 | Neilson | 101/415.1 |
| 4,104,968 | 8/1978 | Schwaab et al. | 101/415.1 |
| 4,702,166 | 10/1987 | Depa | 101/415.1 |
| 5,267,512 | 12/1993 | Miyoshi et al. | 101/216 |

FOREIGN PATENT DOCUMENTS

| | | | |
|---|---|---|---|
| 0252746 | 7/1987 | European Pat. Off. | 101/415.1 |
| 0388929 | 1/1924 | Germany | 101/415.1 |
| 0079157 | 6/1980 | Japan | 101/415.1 |
| 629100 | 3/1987 | Japan . | |
| 2193 | 1/1990 | Japan . | |
| 542665 | 2/1993 | Japan . | |
| 0542665 | 2/1993 | Japan | 101/415.1 |

*Primary Examiner*—Edgar S. Burr
*Assistant Examiner*—Anthony H. Nguyen
*Attorney, Agent, or Firm*—Ronald P. Kananen

[57] ABSTRACT

A printing plate lock-up apparatus for a plate cylinder in a printing press comprises a groove defined in the plate cylinder and having an essentially circular cross section, the groove having an opening end opening to the outer periphery of the plate cylinder and having a width in the circumferential direction smaller than the internal diameter, the opening end having one edge engageable with a turned back edge of the printing plate, an engaging member disposed along the groove and having mating surfaces slidably contacting with the inner periphery of the groove for permitting rotation of the engaging member relative to the groove, the engaging member having an engaging hook engageable with a turned back edge, and having a thickness permitting withdrawal and installation through the opening end, and an operation assembly cooperating with the engaging member for operating the latter to rotate within the groove, the operation assembly maintaining an angular phase of the engaging means at least in the position where the engaging hook of the engaging member hooks the trailing end side turned back edge.

7 Claims, 7 Drawing Sheets

PRINTING PLATE LOCK-UP APPARATUS FOR PLATE CYLINDER

BACKGROUND OF THE INVENTION

1. Field of said Invention

The present invention relates generally to a printing plate lock-up apparatus for a plate cylinder in a printing press, such as a rotary press. More specifically, the invention relates to a printing plate lock-up apparatus of the type having a groove opening on the periphery of the plate cylinder and extending in a longitudinal direction, and an engaging member rotating within the groove for engaging with a printing plate.

2. Description of the Related Art

In the field of rotary presses, various constructions of printing plate lock-up apparatus of the type having a groove opening on the periphery of the plate cylinder and extending in longitudinal direction and an engaging member rotating within the groove for engaging with a printing plate, have been known. For example, Japanese Examined Utility Model Publication No. 62-9100, Japanese Examined Patent Publication No. 2-193 and Japanese Unexamined Patent Publication No. 5-42665 disclose a printing plate lock-up apparatus of the type set forth above.

The printing plate lock-up apparatus disclosed in the above-identified Japanese Examined Utility Model Publication No. 62-9100 includes a groove opening in the longitudinal direction of a plate cylinder. The edge portion of the groove serves for hooking a turned back portion of a printing plate located at the leading side with respect to a direction of rotation of the plate cylinder during printing. A printing plate tightening bar is disposed within the groove in a rotatable fashion and has an engaging claw for engaging with another turned back portion of the printing plate located at the trailing end side. A toggle switching mechanism is interposed between the center of rotation of the bar and the center of the plate cylinder for switching a symmetric angular displacement position of the bar in two directions, and an operation means is provided for externally driving the bar for rotation.

On the other hand, the printing plate lock-up apparatus disclosed in the above-identified Japanese Examined Patent Publication No. 2-193 has a groove opening in the longitudinal direction of a plate cylinder. The edge portion of the groove serves for hooking a turned back portion of a printing plate located at the leading side with respect to a direction of rotation of the plate cylinder during printing. A cam member is disposed within the groove in a rotatable fashion. The cam member is provided with a curved peripheral surface having a radius of curvature substantially corresponding to the radius of curvature of the bottom of the groove. The groove has an outer side portion having a greater volume than that defined by the bottom portion. The cam disposed within the bottom portion of the groove is provided with a cut-out extending substantially the whole longitudinal length of the bottom surface of the bottom portion of the groove. Within the upper portion of the groove, a spring has a substantially U-shaped configuration and a hooked upper end for engaging with the turned back edge of the printing plate in the rotating direction of the plate cylinder during printing. The spring cooperates with a toggle member which has a lower end portion of complementary configuration to the cam member so as to cause a rocking motion of the spring and to maintain the spring at a rocked position. Therefore, depending upon the rotating direction of the cam member, the rocking, direction of the spring can be alternated.

Japanese Unexamined Patent Publication No. 5-42665 discloses the printing plate lock-up apparatus including a groove opening in a longitudinal direction of a plate cylinder. The edge portion of the groove serves for hooking a turned back portion of a printing plate located at the leading side with respect to a direction of rotation of the plate cylinder during printing. A bar is rotatably disposed within the groove. A resilient member having a bent engaging portion is mounted on the bar. The engaging portion of the resilient member is adapted to engage with the turned back portion of the printing plate at the trailing side with respect to the rotating direction of the plate cylinder during printing. An operation means is provided for operating the bar for rotation such that the engaging portion of the resilient member is displaced toward the edge engaging with the leading end side of the printing plate, and for maintaining a predetermined angular displacement phase of the bar.

Here, as can be appreciated, the printing plate lock-up apparatus is the apparatus for loading the printing plate on the plate cylinder. Failure of the printing plate lock-up apparatus directly results in a shut down of the overall printing press or rotary press. Therefore, it has been strongly required that the printing plate lock-up apparatus is easy to maintain and repair.

To this end, the printing plate lock-up apparatus disclosed in the above-mentioned Japanese Examined Utility Model Publication No. 62-9100 constructs the overall mechanism of the apparatus as an integral block having a surface matching with the peripheral surface of the plate cylinder. The integral block is disposed within a relatively large groove so that whole block can be replaced when failure occurs.

Accordingly, though it may facilitate repairing, the disclosed apparatus requires a large number of parts, and further requires high surface precision at the mating surfaces for installation of the integral block, thus resulting in a high production cost.

Also, since a relatively large groove has to be formed through a machining process, a difficulty is encountered in an application for a plate cylinder having a relatively thin wall thickness, such as a divided cylinder used in newspaper printing. The divided cylinder is disclosed in U.S. Pat. No. 5,267,512.

The printing plate lock-up apparatus disclosed in Japanese Examined Patent Publication No. 2-193 permits removal and installation of the cam member and the bar-shaped toggle member through the opening end of the groove opening to the periphery of the plate cylinder. At the occurrence of failure, the cam member and the bar-shaped toggle member are removed from and re-installed in the groove through the opening end.

Therefore, this apparatus also facilitates repairing. However, two members, i.e., the cam member and the bar-shaped toggle member, are required to be disposed within the groove, and the toggle member must be coupled with the spring. Thus, the number of parts is not satisfactorily small. Furthermore, since the groove has a relatively complicated cross section, machining of such a groove is not easy resulting in a high production cost.

Furthermore, since the shown apparatus requires the groove to have two portions, i.e., the upper portion and the bottom portion, sufficient depth of the groove is inherently required. Therefore, the shown apparatus is not practically possible to apply for the plate cylinder having a relatively thin wall, such as the divided cylinder in the newspaper printing press.

On the other hand, the apparatus disclosed in Japanese Unexamined Patent Publication No. 5-42665 requires only a bar member mounting the resilient member to be disposed within the groove having a substantially semi-circular cross section for rotation thereabout. This permits the construction of the groove to be simple and small.

Therefore, the shown apparatus will be applicable for the plate cylinder having a thin wall, such as the divided cylinder. Also, because of its simple construction, the production cost can be low.

However, the shown apparatus requires parallel movement of the bar member relative to the groove in installation and removal. Therefore, installation and removal of the bar member into and from the groove is not satisfactorily easy to allow a quick repair.

SUMMARY OF THE INVENTION

According to one aspect of the invention, a printing plate lock-up apparatus for a plate cylinder in a printing press comprises:

a groove defined in the plate cylinder and having an essentially circular cross section with a selected internal diameter, the groove having an opening end opening to the outer periphery of the plate cylinder and having a width in a circumferential direction smaller than the internal diameter, the opening end having one edges engageable with a turned back edge of the printing plate located at the leading side with respect to a rotating direction of the plate cylinder during printing;

an engaging member disposed along the groove and having mating surfaces slidably contacting with the inner periphery of the groove for permitting rotation of the engaging member relative to the groove, the engaging member having an engaging hook engageable with a turned back edge of the printing plate located at the trailing side end, and having a thickness permitting withdrawal and installation through the opening end; and an operation assembly cooperated with the engaging member for operating the latter to rotate within the groove, the operation assembly maintaining an angular phase of the engaging member at least in the position where the engaging hook of the engaging member hooks the trailing end side turned back edge.

The engaging member may be separated into a plurality of segments and the operation assembly is provided for each of individual segments of the engaging member, if necessary.

According to another aspect of the invention, a printing plate lock-up apparatus for a plate cylinder in a printing press, comprises:

a groove defined in the plate cylinder and opening on the peripheral surface of the plate cylinder, the groove having an essentially circular cross section defining a receptacle space, and an opening end with opposing and spaced apart edges, the distance between the spaced apart edges being smaller than an internal diameter of the receptacle space, one of the edge of the opening end being shaped for engagement with one side edge of the printing plate;

a rotatable member disposed within the receptacle space, the rotatable member being of an elongated configuration having a first pair of mutually opposing surfaces spaced apart at a first distance substantially corresponding to the internal diameter of the receptacle space and having a second pair of mutually opposing surfaces spaced apart at a second distance smaller than the distance between the spaced apart edges, and the rotatable member having a hook for engaging with the other side edge of the printing plate;

an operating and retaining means cooperating with the rotatable member for rotating the rotatable member within a predetermined angular range defined by a printing plate unloading position and a printing plate loading position, and retaining the rotatable member at least at the printing plate loading position while the printing plate is to be maintained on the periphery of the plate cylinder.

Preferably, the operating and retaining means is coupled with one axial end of the rotatable member. Also, the operating and retaining means may restrict axial movement of the rotatable member.

The operating and retaining means may be placed in a normal active position for restricting the angular displacement of the rotary member within the predetermined angular range, and in an inactive position for permitting angular displacement of the rotary member beyond the predetermined angular range for removal and installation of the rotary member from and into the groove. The rotary member may comprise a plurality of mutually independent segments to be placed in the groove in alignment with each other, the segments being operated independently of each other by the operating and retaining means in loading and unloading the printing plate and handles as an integrated assembly in removal and installation with respect to the groove.

BRIEF DESCRIPTION OF THE DRAWINGS

The present invention will be understood more fully from the detailed description given herebelow and from the accompanying drawings of the preferred embodiment of the present invention, which, however, should not be taken to limit the invention, but are for explanation and understanding only.

In the drawings:

FIGS. 3A and 3B are sections similar to FIG. 1 but showing the condition where the engaging member is engaging with a printing plate, in which FIG. 3A shows a section as seen in the direction indicated by arrow 3A in FIG. 8, and FIG. 3B shows a section as seen in the direction indicated by arrow 3B in FIG. 8;

DESCRIPTION OF THE PREFERRED EMBODIMENT

The present invention will be discussed hereinafter in detail with reference to the accompanying drawings. In the following description, numerous specific details are set forth in order to provide a thorough understanding of the present invention. It will be apparent, however, to those skilled in the art that the present invention may be practiced without these specific details. In other instances, well-known structures are not shown in detail in order not to unnecessarily obscure the present invention.

Figure 1:
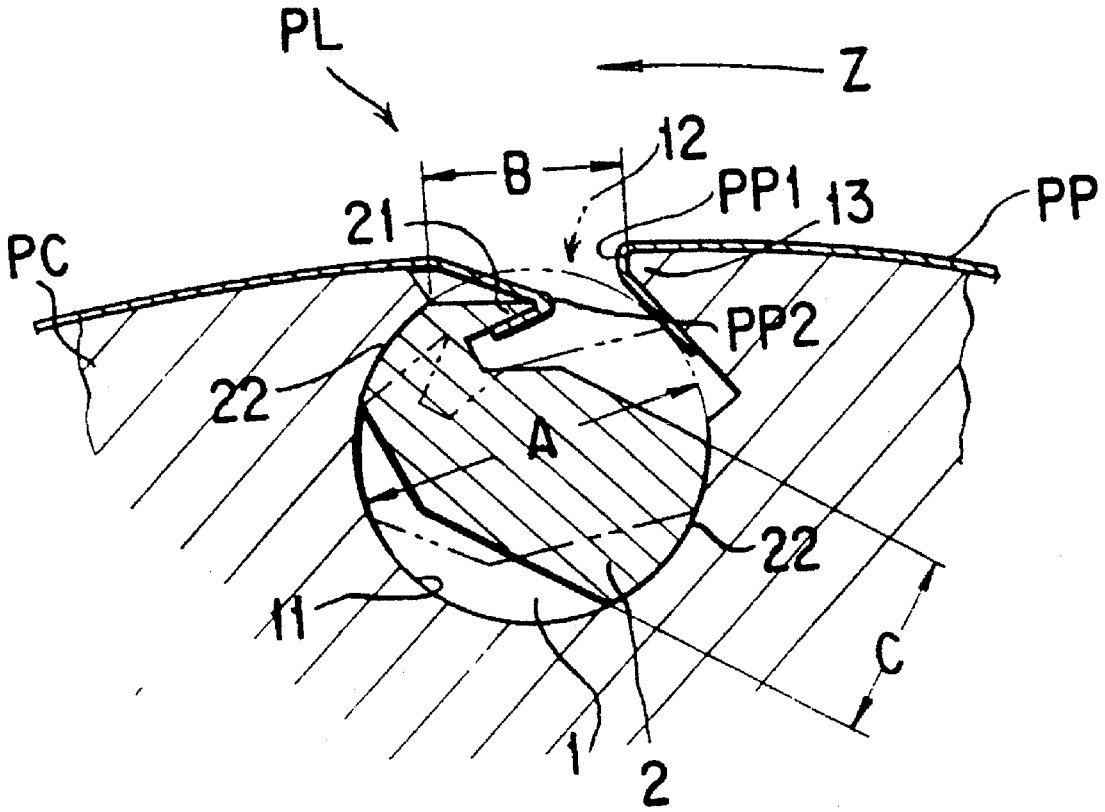
FIG. 1 is a section showing a cross section of the preferred embodiment of a printing plate lock-up apparatus according to the present invention, as sectioned transversely to a longitudinal axis.
Figure 7:
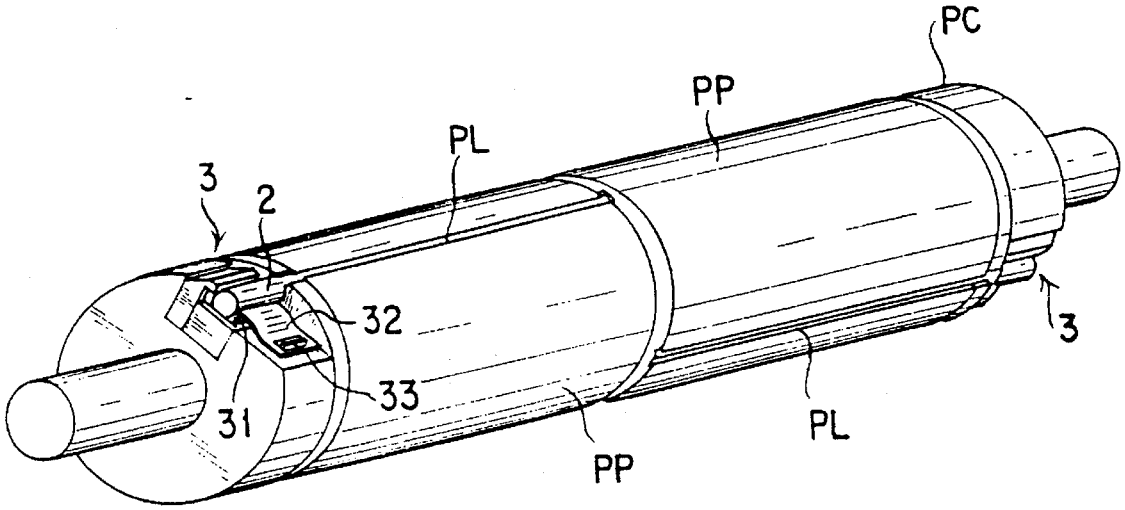
FIG. 7 is a perspective view of a double-width plate cylinder, in which the printing plate lock-up apparatus of FIG. 1 according to the present invention is applied.

FIG. 1 is a section of the preferred embodiment of a printing plate lock-up apparatus PL for a plate cylinder PC according to the present invention shown in FIG. 7 as viewed in an axial direction.

The plate cylinder PC is formed with a groove 1 extending substantially in parallel to the rotation axis thereof. As seen from FIG. 1, a major part of the section of the groove 1 has an arc-shaped curved surface 11 with a diameter A. The diameter A of the arc-shaped curved surface 11 may be selected appropriately. The groove 1 has an opening end 12 opening on the outer peripheral surface of the plate cylinder PC. The width B of the opening end 12 is smaller than the diameter A of the arc-shaped curved surface. The opening end 12 of the groove 1 thus extends in parallel to the rotation axis of the plate cylinder and has overhanging opposite side edges.

One side (i.e., the right side in FIG. 1) edge located at the leading side with respect to a rotational direction of the plate cylinder PC during a printing operation is provided with a hooking end 13. The hooking end 13 is shaped into a complementary configuration to a turned back edge PP1 of a printing plate PP located at the leading end side. On the other hand, the other side (left side in FIG. 1) edge is tapered in an ascending manner. One axial end of the groove 1 opens to the axial end surface of the plate cylinder PC.

Figure 6:
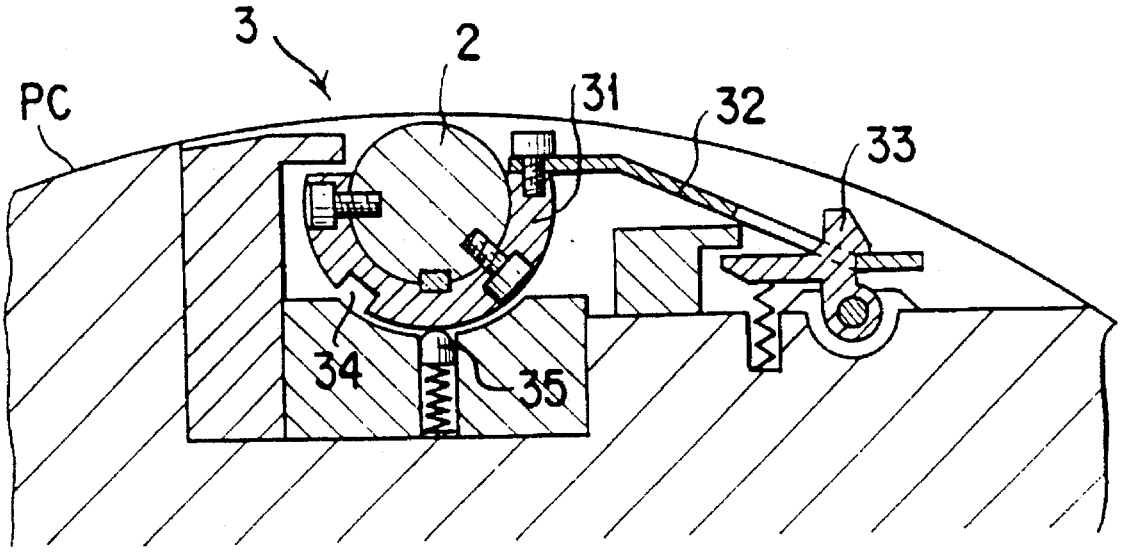
FIG. 6 is a section of a further embodiment of the printing plate lock-up apparatus according to the present invention, sectioned transversely to the longitudinal axis.

An engaging member 2 for engaging with the other turned back edge PP2 of the printing plate PP, located at the trailing side with respect to a rotational direction of the plate cylinder PC during printing operation, is rotatably disposed within the groove 1. The engaging member 2 extends substantially through an overall length of the groove 1. One axial end of the engaging member 2 extends from one axial end of the groove 1 for permitting an external access of the engaging member. In the shown embodiment, the extending axial end portion extending from the axial end of the groove 1 is formed into a generally cylindrical configuration as shown in FIGS. 6 and 7.

The engaging member 2 is formed into a generally rectangular cross-section with an engaging hook 21 for engaging with the turned back edge PP2 of the printing plate PP at the trailing side. The thickness C of the general portion of the engaging member 2 is selected to be smaller than the width B of the opening end 12 of the groove 1 for facilitating installation into and removal from the latter. The engaging member 2 has mutually opposing shorter edge surfaces 22 slightly curved in complement with the curvature of the arc-shaped curved surface 11 of the groove 1. On the other hand, the length of the longer edge surfaces of the engaging member 2 substantially corresponds to the diameter A of the arc-shaped curved surface of the groove so that the curved shorter edge surfaces 22 may be constantly kept in contact with the arc-shaped curved surface 11 for sliding thereabout. Therefore, the engaging member 2 can be disposed within the groove 1 in a rotatable fashion.

On the other hand, an operation assembly 3 is provided at one axial end of the plate cylinder PC. The operation assembly 3 is coupled with the axial end portion of the engaging member 2 extending from the axial end of the groove 1 for rotating the latter within the groove 1. In the shown embodiment, the operation assembly 3 is constructed as illustrated in FIG. 6. Namely, the operation assembly 3 includes an arc-shaped ring 31. As seen, the ring 31 is rigidly secured on the cylindrical axial end portion of the engaging member 2 by means of keying bolts for rotation together with the engaging member. A lever 32 is connected to the ring 31 at one end. A releasable hook 33 is cooperated with the lever 32 so that the hook 33 may engage with a window opening defined in the lever 32 in a releasable fashion.

The ring 31 is formed with at least one positioning recess 34. The positioning recess 34 cooperates with a spring loaded positioning member 35 to click rotational movement of the engaging member 2 at a predetermined angular position.

The operation of the above-mentioned construction of the preferred embodiment of the printing plate lock-up apparatus according to the present invention will be discussed hereinafter.

Upon loading of the printing plate PP on the, periphery of the plate cylinder PC for a printing operation, the leading end side turned back edge PP1 of the printing plate PP is initially engaged with the hooking end 13 of the groove 1. Then, the plate cylinder PC is driven to rotate in the direction corresponding to the rotational direction during printing (i.e. the direction indicated by arrow Z in FIG. 1) to wrap the printing plate PP on the peripheral surface of the plate cylinder. After substantially one cycle of rotation of the plate cylinder, the trailing end side turned back edge PP2 reaches the opening end 12 of the groove 1.

At this position, by releasing the releasable hook 33 from engagement with the window opening of the lever 32 pivotal movement of the lever 32 is permitted. At this time, the lever 32 is pivoted in a counterclockwise direction in FIG. 6 to be placed at the raised position. According to pivotal movement of the lever 32, the ring 31 and the engaging member 2 are rotated in the counterclockwise direction. At the end of the pivotal stroke of the lever 32, the engaging member 2 is placed at a position illustrated by the two dotted line in FIG. 1. As can be seen from FIG. 1, at this position, the engaging hook 21 of the engaging member 2 is substantially opposed to the backside of the trailing end side turned back edge PP2.

Subsequently, the lever 32 is again pivoted in the reversed direction, i.e. in a clockwise direction as seen in FIG. 6. At the end of the pivotal stroke, the lever 32 comes into engagement with the hook 33 as in the initial position. During this pivotal motion of the lever 32, the ring 31 and the engaging member 2 are rotated in the clockwise direction of FIG. 1. Then, the engaging hook 21 of the engaging member 2 engages with the trailing end side turned back edge PP2 of the printing plate PP.

As is apparent to those skilled in the art, the length between the turned back portions PP1 and PP2 is equal to or slightly shorter than the circumferential distance between the hooking end 13 of the groove 1 and the engaging hook 21 of the engaging member 2 through substantially an entire circumferential periphery of the plate cylinder PC. Therefore, the printing plate PP is tightly fitted onto the circumferential surface of the plate cylinder with a tension provided by slight resiliency of the lever 32.

Next, a discussion will be provided for the process of removal of the engaging member from the groove 1 when failure is caused in the preferred embodiment of the printing plate lock-up apparatus and removal of the engaging member 2 is required for repairing, with reference to FIGS. 1 and 2A to 2F.

Figure 2A:
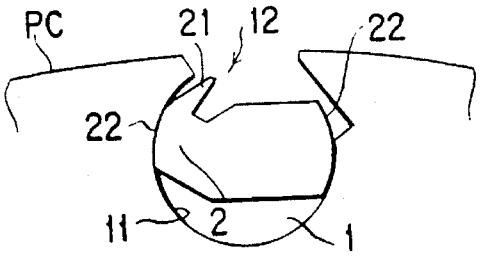
FIGS. 2A to 2F are explanatory illustrations showing a sequence of a process for removing an engaging member from a groove.
Figure 2D:
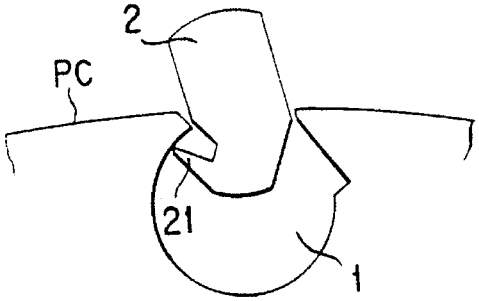
Figure 2B:
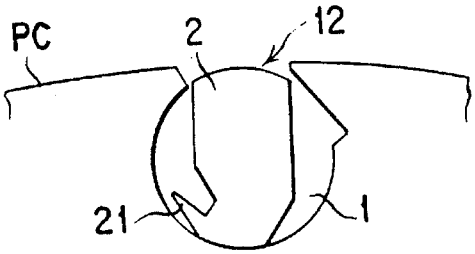

Initially, the operation assembly 3 which restricts angular range of rotation of the engaging member 2 within phases illustrated by the solid line and the two-dot line in FIG. 1, is disassembled to release the required restriction against the rotation of the engaging member and thus to permit free rotation of the engaging member 2. Thereafter, by sliding the shorter side edge surfaces 22 on the arc-shaped curved surface 11 of the groove 1, the engaging member 2 is rotated along the surface 11 of the groove 1 (FIG. 2A). Then, placing the engaging hook 21 at the lower side, the engaging member 2 is placed in alignment with the opening end 12 of the groove 1 (FIG. 2B). Then, a part of the engaging member 2 is removed out of the groove 1 (FIG. 2C). As seen from FIG. 2D, during the operation to withdraw the engaging member 2 from the groove, the engaging hook 21 abuts on the surface of the groove 1 at the position of the overhanded end at the trailing side of the groove.

Figure 2E:
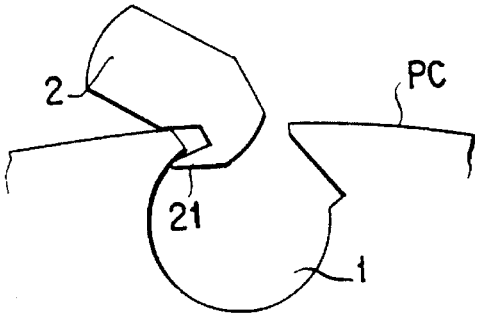
Figure 2C:
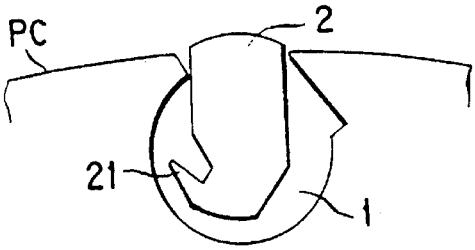
Figure 2F:
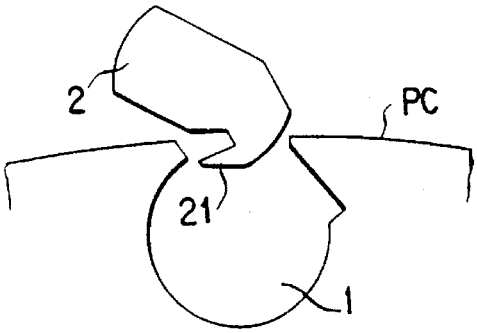

Then, the engaging member 2 is pivoted in a counterclockwise direction about the abutting point between the engaging hook 21 and the inner periphery of the groove 1 (FIG. 2E). At this time, the tapered edge of the overhanded end contributes to permit pivotal movement. By this pivotal motion, most of the engaging member 2 except for the engaging hook 21 is removed from the groove as shown in FIG. 2E. Thereafter, the engaging hook 21 is released from the inner periphery of the groove as shown in FIG. 2F.

Through the process set forth above, the engaging member 2 can be removed from the groove 1. At this disassembled condition, a repairing operation for the printing plate lock-up apparatus can be easily performed.

After completion of the repairing operation, the engaging member 2 is re-installed within the groove 1 in substantially an opposite sequence of processes to those in the removal.

It should be appreciated that re-installation of the engaging member 2 is performed while paying attention to the angular phase of the engaging member within the groove 1. Namely, the angular phase of the engaging member 2 being installed within the groove 1 is selected so that, at the position of the operation assembly 3 as illustrated in FIG. 6, the engaging member 2 is placed at the phase position illustrated by solid line in FIG. 1, and when the lever 32 is placed in the raised position while releasing the window opening from the hook 33, and the positioning member 35 is in engagement with the positioning recess 34, the engaging member 2 is placed at the phase position as illustrated by the two-dot line in FIG. 1. Thereafter, the operation assembly 3 is re-assembled. By assembling the operation assembly 3, the engaging member 2 is restricted from axial displacement with respect to the groove 1.

Figure 3A:
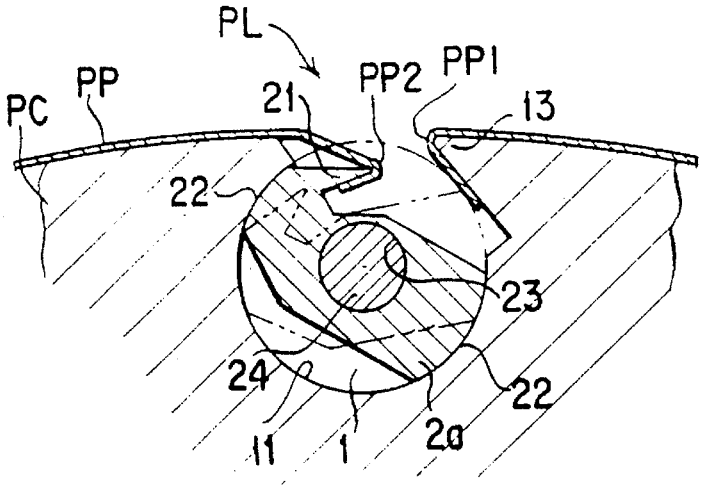
Figure 3B:
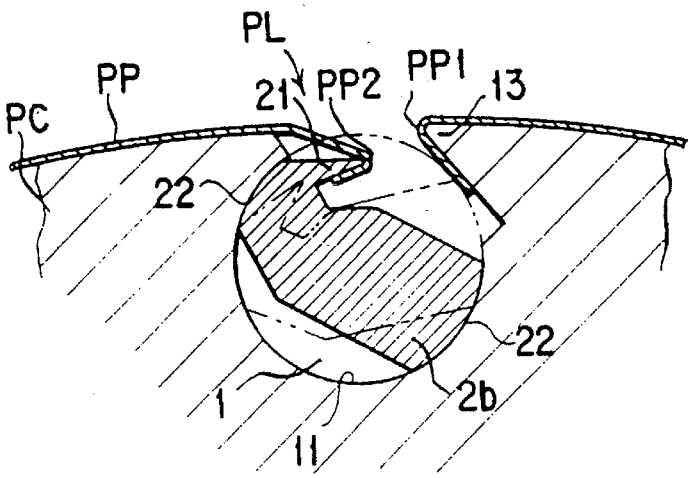
Figure 8:
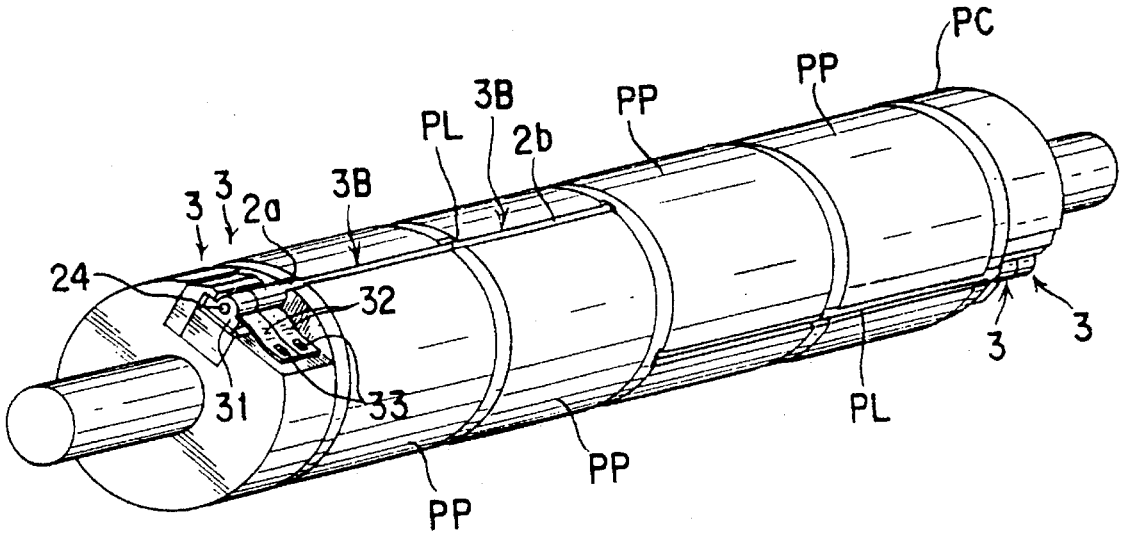
FIG. 8 is a perspective view of a double-width plate cylinder, in which the printing plate lock-up apparatus of FIGS. 3A and 3B according to the present invention is applied.

FIGS. 3A, 3B and 8 show another embodiment of the printing plate lock-up apparatus according to the present invention, in which the engaging member 2 in the former embodiment of FIGS. 1 and 7, is replaced with separated engaging members 2*a* and 2*b*. FIG. 3 is a section similar to FIG. 1 at the position shown by the arrow 3A in FIG. 8, and FIG. 3B is a section at the position shown by the arrow 3B in FIG. 8.

The separated engaging members 2*a* and 2*b* are placed in the groove 1 in alignment with each other. The engaging member 2*a* is formed with an axial portion extending through opening 23. On the other hand, the engaging member 2*b* is provided with an operation shaft 24 extending from the axial end thereof. The operation shaft 24 is engaged with the through opening 23 for mutual sliding rotation. The operation shaft 24 extends through the through opening 23 and extends from the axial end of the through opening 23. The engaging members 2*a* and 2*b*, which are assembled by passing the operation shaft 24 through the through opening 23, extend substantially the overall length of the groove 1. The outer side axial end of the engaging member 2*a* remote from the engaging member 2*b* extends from the axial end of the groove in the same manner as that of the former embodiment. Also, the operation shaft 24 further extends from the outer side axial end of the engaging member 2*a*. For respective axial ends of the engaging member 2*a* and the operation shaft 24, the operation assemblies 3 are provided separately.

It should be appreciated that the shown, embodiment is the same or, in the alternative, similar or equivalent to the former embodiment in other constructions. Namely, the configuration of the groove, the construction of the engaging members except for those discussed above, and the construction of the operation assembly 3 are the same or similar to those of the former embodiment of FIGS. 1 and 7.

As can be appreciated herefrom, in the shown embodiment, the separated engaging members 2*a* and 2*b* can be operated independently in loading and unloading the printing plate PP to the plate cylinder PC in substantially the same manner as that of the former embodiment.

On the other hand, upon removal and reinstallation of the engaging members 2*a* and 2*b* for the purpose of repair and/or maintenance, the engaging members 2*a* and 2*b* are removed and installed from and into the groove 1 in an assembled form. Therefore, the processes illustrated in FIGS. 2A to 2F are applicable for the shown embodiment.

Figure 4:
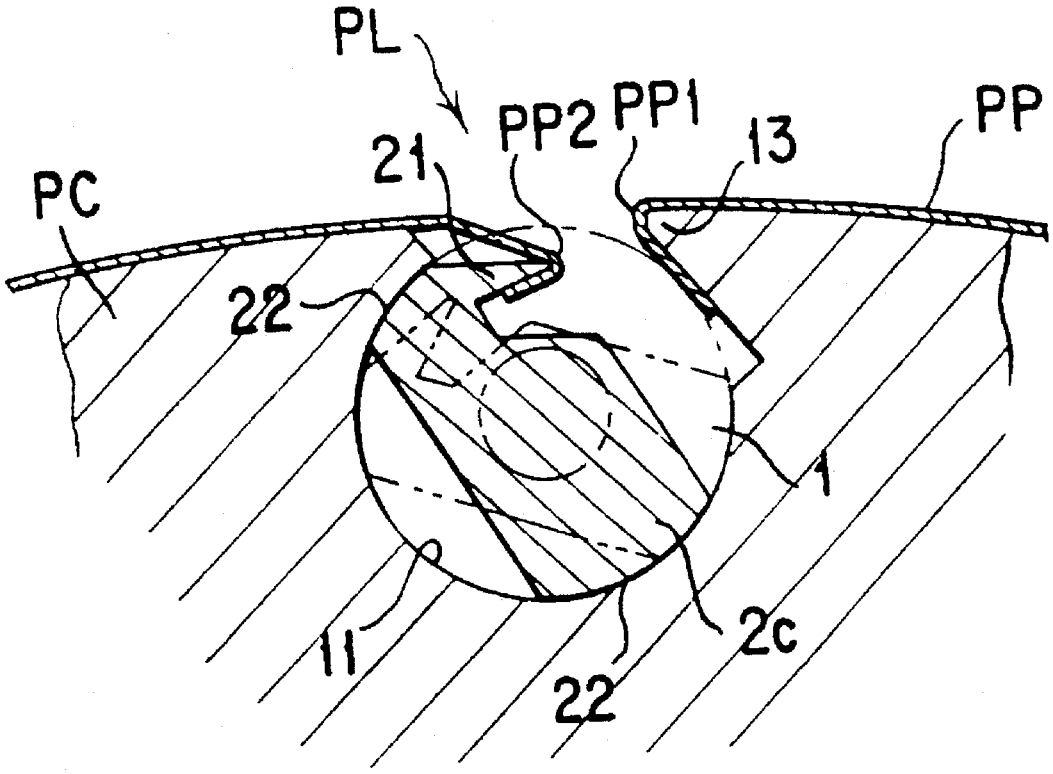
FIG. 4 is a section showing another embodiment of the printing plate lock-up apparatus according to the present invention, in which an engaging member of a different configuration from that of the former embodiment is employed, which is sectioned transversely to the longitudinal axis.

FIG. 4 shows a further embodiment of the printing plate lock-up apparatus according to the present invention, in which an engaging member 2*c* is used having a different configuration than the engaging members 2, 2*a* and 2*b* in the former embodiments of FIGS. 1, 3A and 3B. In the shown embodiment, the engaging hook 21 of the engaging member 2*c* is not extended beyond the plane of the longer edge side surface of the engaging member 2*c*. It should be noted that the small circle at the center of the engaging member 2*c* illustrated by a two-dot line represents an imaginary position of the through opening 23 and the operation shaft in the immediately preceding embodiment.

The shown embodiment of the engaging member 2*c* permits a loading and unloading operation of the printing plate PP to the plate cylinder PC in substantially the same manner as the former embodiments.

Figure 5A:
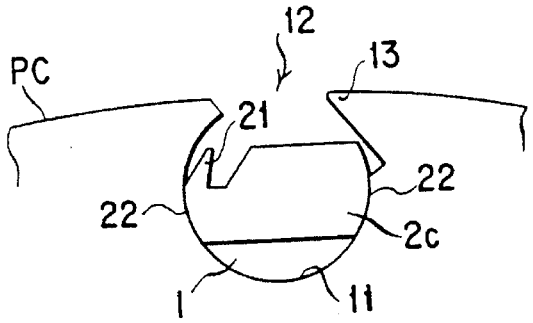
FIGS. 5A to 5C are explanatory illustrations showing a sequence of processes for removing the engaging member from the groove in the embodiment of FIG. 4.
Figure 5B:
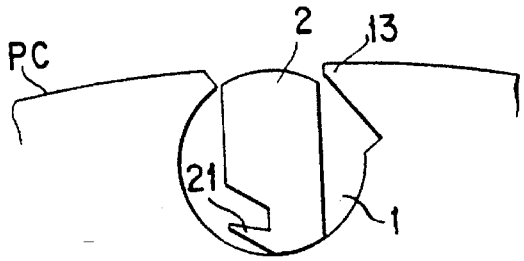
Figure 5C:
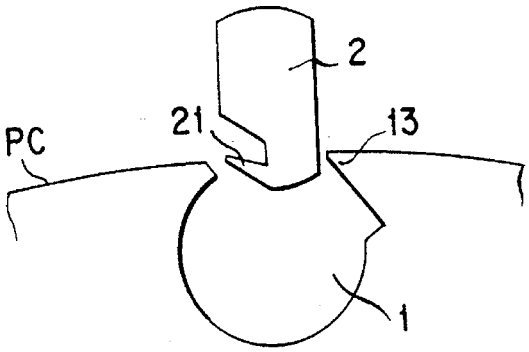

On the other hand, removal and installation of the engaging member 2*c* from and into the groove 1 is performed through the process as illustrated in FIG. 5. Initially, the operation assembly 3 which restricts an angular range of rotation of the engaging member 2 within phases illustrated by the solid line and the two-dot line in FIG. 4, is disassembled to the extent necessary to release restriction against the rotation of the engaging member and thus to permit free rotation of the engaging member 2*c*. Thereafter, when sliding the shorter side edge surfaces 22 on the arc-shaped curved surface 11 of the groove 1, the engaging member 2*c* is rotated along the surface 11 of the groove 1 (FIG. 5A). Then, placing the engaging hook 21 at the lower side, the engaging member 2*c* is placed in alignment with the opening end 12 of the groove 1 (FIG. 5B). Then, the engaging member 2*c* is removed out of the groove 1 by drawing it in straight (FIG. 5C).

Through the process set forth above, the engaging member 2*c* can be removed from the groove 1. At this disassembled condition, a repairing operation for the printing plate lock-up apparatus can be further easily performed.

After completion of the repairing operation, the engaging member 2*c* is re-installed within the groove 1 in a substantially opposite sequence of processes to those in the removal.

It should be appreciated that re-installation of the engaging member 2*c* is performed while paying attention to the angular phase of the engaging member within the groove 1. Namely, the angular phase of the engaging member 2*c* being installed within the groove 1 is selected so that, at the position of the operation assembly 3 as illustrated in FIG. 6, the engaging member 2*c* is placed at the phase position illustrated by a solid line in FIG. 4, and when the lever 32 is placed in the raised position while releasing the window opening from the hook 33, and the positioning member 35 is in engagement with the positioning recess 34, the engaging member 2*c* is placed at the phase position as illustrated by the two-dot line in FIG. 4. Thereafter, the operation assembly 3 is re-assembled. By assembling the operation assembly 3, the engaging member 2*c* is restricted in its axial displacement with respect to the groove 1.

Although the invention has been illustrated and described with respect to an exemplary embodiment thereof, it should be understood by those skilled in the art that the foregoing and various other changes, omissions and additions may be made therein and thereto, without departing from the spirit and scope of the present invention. Therefore, the present invention should not be understood as limited to the specific embodiment set out above but to include all possible embodiments which can be embodied within a scope encompassed by and equivalents thereof.

According to the present invention, since the printing plate lock-up apparatus is constructed with the groove having the cross section transverse to the rotation axis in essentially a circular configuration with an appropriate diameter, the engaging member rotatably disposed in the groove and having the engaging hook to engage with the turned back edge of the printing plate, and the operation assembly provided outside of the groove and adapted to rotatively operate the engaging member, the construction of the apparatus can be simplified. Also, since the present invention employs a simple construction and configuration in each element of the apparatus, machining of the element becomes easy to contribute to a lowering of the production cost. Furthermore, since the present invention facilitates removal and installation of the engaging member with respect to the groove, a repair and/or maintenance operation can be quickly performed.

Furthermore, the simple construction of the printing plate lock-up apparatus according to the present invention permits downsizing of the apparatus to the extent that the apparatus is satisfactorily applied even for the divided plate cylinder which has a relatively thin wall. Furthermore, as illustrated in the second embodiment, by providing the separated engaging members which can be operated independently in loading and unloading the printing plate and can be removed and installed from and into the groove in an integrated form, handling and maintenance can be satisfactorily standardized to lighten the load on the user.

What is claimed is:

1. A printing plate lock-up apparatus for a plate cylinder in a printing press, comprising:

a groove defined in said plate cylinder and having an essentially circular cross section with a selected internal diameter, said groove having an opening end opening to an outer periphery of said plate cylinder, said opening end having a width in a circumferential direction of the plate cylinder smaller than the internal diameter, said opening end having one edge engagable with a turned back edge of said printing plate located at a leading side with respect to a rotating direction of said plate cylinder during printing;

an engaging member disposed along said groove and having mating surfaces slidably contacting with the inner periphery of said groove for permitting rotation of said engaging member relative to said groove, said engaging member having an engaging hook for engaging a turned back edge of said printing plate located at a trailing side end with respect to a rotating direction of said plate cylinder during printing, and said engaging member having a cross-sectional thickness in a first direction that is smaller than the width of the opening end for permitting withdrawal and installation of the engaging member through said opening end; and an operation assembly operably connected to said engaging member for operating the latter to rotate within said groove, said operation assembly maintaining an angular phase of said engaging member at least in a position where said engaging hook of said engaging member hooks the trailing end side turned back edge.

2. A printing plate lock-up apparatus as set forth in claim 1, wherein said engaging member is separated into a plurality of individual segments and said operation assembly includes a separate operation assembly for each of the individual segments of said engaging member.

3. A printing plate lock-up apparatus for a plate cylinder in a printing press, comprising:

a groove defined in said plate cylinder and opening on a peripheral surface of said plate cylinder, said groove having an essentially circular cross section defining a receptacle space, said groove having an opening end with opposing and spaced apart edges, the distance between the spaced apart edges being smaller than an internal diameter of said receptacle space, one of the edges of said opening end being shaped for engagement with one side edge of said printing plate;

a rotatable member disposed within said receptacle space, said rotatable member being of an elongated configuration having a first pair of mutually opposing surfaces spaced apart in a first distance substantially corresponding to the internal diameter of said receptacle space and having a second pair of mutually opposing surfaces spaced apart in a second distance smaller than the distance between said spaced apart edges, and said rotatable member having a hook for engaging with the other side edge of said printing plate;

an operating and retaining means operably connected to said rotatable member for rotating said rotatable member within a predetermined angular range defined by a printing plate unloading position and a printing plate loading position, and retaining said rotatable member at least at said printing plate loading position while said printing plate is to be maintained on the periphery of said plate cylinder.

4. A printing plate lock-up apparatus as set forth in claim 3, wherein said operating and retaining means is coupled with one axial end of said rotatable member.

5. A printing plate lock-up apparatus as set forth in claim 4, wherein said operating and retaining means has means for restricting axial movement of said rotatable member.

6. A printing plate lock-up apparatus as set forth in claim 3, wherein said operating and retaining means is movable between a normal active position for restricting the angular displacement of said rotary member within the predetermined angular range, and an inactive position for permitting angular displacement of said rotary member beyond the predetermined angular range for removal and installation of said rotary member from and into said groove.

7. A printing plate lock-up apparatus as set forth in claim 6, wherein said rotary member comprises a plurality of mutually independent segments placed in said groove in alignment with each other, the segments being operable independently of each other by said operating and retaining means for loading and unloading said printing plate and being an integrated assembly during removal and installation of the rotary member with respect to said groove.

* * * * *